United States Patent [19]

Shoji

[11] Patent Number: 4,894,685

[45] Date of Patent: Jan. 16, 1990

[54] MULTICOLOR IMAGE FORMING METHOD AND APPARATUS

[75] Inventor: Hisashi Shoji, Hachioji, Japan

[73] Assignee: Konishiroku Photo Industry Co., Ltd., Tokyo, Japan

[21] Appl. No.: 106,856

[22] Filed: Oct. 6, 1987

[30] Foreign Application Priority Data

Oct. 7, 1986 [JP] Japan ..... 61-239739
Oct. 7, 1986 [JP] Japan ..... 61-240739

[51] Int. Cl.[4] ..... G03G 15/04; G03G 15/08

[52] U.S. Cl. ..... 355/246; 355/204; 355/326; 430/30; 430/122

[58] Field of Search ..... 355/14 R, 14 F, 14 D, 355/30 D, 3 R, 4, 246, 204, 326; 118/663, 691, 712, 645; 430/30, 122, 357

[56] References Cited

U.S. PATENT DOCUMENTS

| | | | |
|---|---|---|---|
| 4,313,671 | 2/1982 | Kuru | 355/14 D |
| 4,348,099 | 9/1982 | Fantozzi | 355/14 E |
| 4,372,672 | 2/1983 | Pries | 355/14 R |
| 4,533,234 | 8/1985 | Watai et al. | 355/14 D |
| 4,682,880 | 7/1987 | Fujii et al. | 355/4 |

FOREIGN PATENT DOCUMENTS

| | | |
|---|---|---|
| 3526878 | 1/1986 | Fed. Rep. of Germany . |
| 56-164354 | 12/1981 | Japan . |
| 61-239268 | 10/1986 | Japan . |

*Primary Examiner*—A. C. Prescott
*Attorney, Agent, or Firm*—Jordan B. Bierman

[57] ABSTRACT

A multicolor image forming method and apparatus wherein a reference toner image is formed on a non-transfer portion of an image retainer by a developing device, and image forming conditions are set in accordance with the reflective density of the reference toner image. The reference toner image is a pattern having a predetermined recording area percentage.

16 Claims, 8 Drawing Sheets

FIG. 8
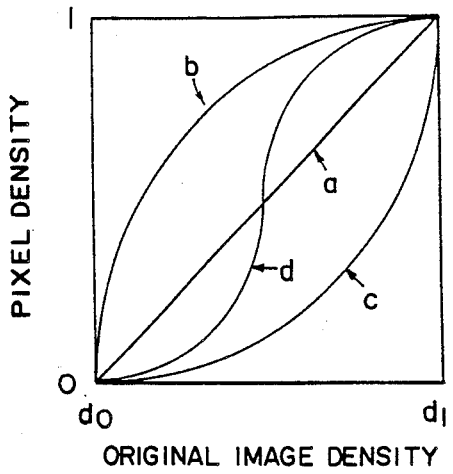
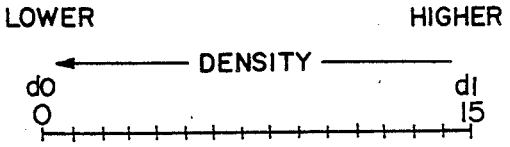
FIG. 9(a)
FIG. 9(b)
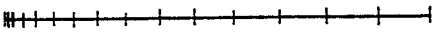
FIG. 9(c)
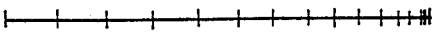
FIG. 9(d)
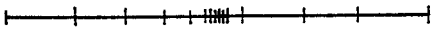

MULTICOLOR IMAGE FORMING METHOD AND APPARATUS

BACKGROUND OF THE INVENTION

1. Field of the Invention

The present invention relates to an electrophotographic multicolor image forming method and apparatus, more particularly, to a multicolor image forming method for forming a plurality of toner images on an image retainer in a superposed manner and an apparatus therefor.

2. Description of the Prior Art

The aforementioned electrophotographic image forming is realized by carrying out two or more cycles each including the steps of (1) charging, (2) image exposure and (3) development on an image retainer which has a photoconductive layer on a conductive substrate (as is disclosed in Japanese Patent Application No. 184381/1983). By using an image retainer having a transparent insulating layer on the outer side of a photoconductive layer, another method carries out two or more cycles each including the steps of (1) primary charging, (2) simultaneous secondary charging and image exposure, (3) uniform charging, and (4) development, or still another carries out two or more cycles each including the steps of (1) primary charging, (2) secondary charging, (3) image exposure and (4) development (as is disclosed in Japanese Patent Application No. 183152/1983). These methods make possible the multicolor developments or image compositions on the image retainer, and these superposed images can be transferred to the transfer material by a single transfer process, to provide an apparatus for forming a multicolor or composed image with a simple structure. Therefore, the developing method has to be carried out under the conditions, as disclosed in Japanese Patent Application No. 57446/1983 or 192712/1985, by using a developer made of a mixture of a non-magnetic toner and a magnetic carrier. This developing method belongs one kind of magnetic brush developing method and is characterized in that only the toner is caused to fly onto the latent image face of the image retainer by an AC bias while the magnetic brush being kept away from contact with the image retainer.

One example of the aforementioned image forming apparatus is practised by a developing device which forms latent images of different colors by latent image forming means and uses toners of colors corresponding to the respective latent images.

This multicolor image forming apparatus is represented by that in which an image retainer (which will be called a "photosensitive member", as the case may be) having a photoconductive substance on a conductive substrate is irradiated with an optical ray such as a laser beam to form electrostatic latent images. In this apparatus, the multicolor image is formed in the manner, as shown in the flow chart of FIG. 11.

FIG. 11 shows the changes of the surface potential of the image retainer, in which: PH designates an exposed portion of the image retainer; DA an unexposed portion of the image retainer; $T_1$ a toner deposited on the image retainer by a first development; $T_2$ a toner deposited on the image retainer by a second development; and DUP the rise in the potential caused as a result of deposition of the toner $T_1$ on the exposed portion PH by the first development. For simplicity of description, the polarity of the latent image is assumed to be positive.

(1) The image retainer is uniformly charged to have a constant positive surface potential E by a charging device;

(2) A first image exposure is given by using a laser, a cathode ray tube or an LED as an exposure light source so that the potential at the exposed portion PH drops in accordance with the amount of light of exposure.

(3) The electrostatic latent image thus formed is developed by a developing device to which is applied a positive bias substantially equal to the surface potential E of the unexposed portion. As a result, the charged positive toner $T_1$ is deposited on the exposed portion PH at a relatively low potential to form a first toner image. The region formed with this toner image has its potential rising by the DUP as a result of deposition of the charged positive toner $T_1$ but normally takes a potential different from that of the unexposed portion DA.

(4) Next, the surface of the image retainer formed with the first toner image is subjected to a second charging treatment by the charging device so that an even surface potential E prevails irrespective of the presence or absence of the toner $T_1$.

(5) The surface of this image retainer is subjected to a second image exposure to form an electrostatic latent image.

(6) This electrostatic latent image is developed with a charged positive toner $T_2$ of a color different from that of the toner $T_1$ like the previous step (3) to form a second toner image.

This process is carried out a desired number to form a multicolor toner image on the image retainer. This multicolor toner image is transferred to a transfer material and is fixed with heat or under pressure to form a multicolor recorded image. In this meanwhile, the image retainer has its residual toner or charges cleaned off from the surface thereof so that it may be used for a subsequent multicolor image formation, after its multicolor toner image has been transferred to the transfer material.

These multicolor records thus obtained have strict requirements for the color balance because they will appeal directly to the eyes.

(1) The recording characteristics of gradations of the individual color components should be sufficiently identical.

(2) The aging and individual dispersions in the color balance should be small.

We therefore have proposed a method including the steps of forming a reference toner image on an image retainer, detecting the reflective density of the toner image, and feeding back the reflective density detected to image forming conditions, as is disclosed in Japanese Patent Applications Nos. 158456/1984, 179119/1984 and 188690/1984. However, this method has succeeded in holding the maximum density substantially constant but has failed to obtain a condition for holding constant the gradation expression characteristics which are the most important for color expressions.

On the other hand, Japanese Patent Laid-Open No. 57868/1985 has disclosed a method which includes the steps of transferring a toner image to a transparent member of a transfer device and detecting the density. However, this method is required to have the transfer device to be driven highly accurately in addition to the image retainer, thus raising a problem that the overall structure of the apparatus is complicated and enlarged.

SUMMARY OF THE INVENTION

An object of the present invention to provide a multicolor image forming method and an apparatus having the aforementioned simple structure, with means for setting the image forming conditions to hold the color balance constant at all times.

The above specified object can be achieved by a multicolor image forming method comprising the steps of: a multicolor toner image on an image retainer by a plurality of developing means; and transferring said multicolor toner image to a transfer material, wherein the improvement comprises the steps of: forming a reference toner image on a non-transfer portion of said image retainer by any of said developing means; reading out the reflective density of said reference toner image; and setting image forming conditions in accordance with the reflective density read out.

The above-specified object of the present invention can also be achieved by a multicolor image forming apparatus for forming a multicolor image on an image retainer and transferring said multicolor image to a transfer material. In the apparatus of the present invention, a plurality of reference toner images (Patch) having different recording area percentages are formed on non-transfer portions of said image retainer; the reflective densities of said reference toner images are read out; and image forming conditions are set in accordance with the reflective densities read out.

BRIEF DESCRIPTION OF THE DRAWINGS

FIG. 8 is a graph presenting relations between the original image density and the density of pixels providing the recording level;

FIGS. 9(*a*) to 9(*d*) are diagrams plotting the values of reference data set in a reference matrix against the density level;

DESCRIPTION OF THE PREFERRED EMBODIMENTS

Figure 1:
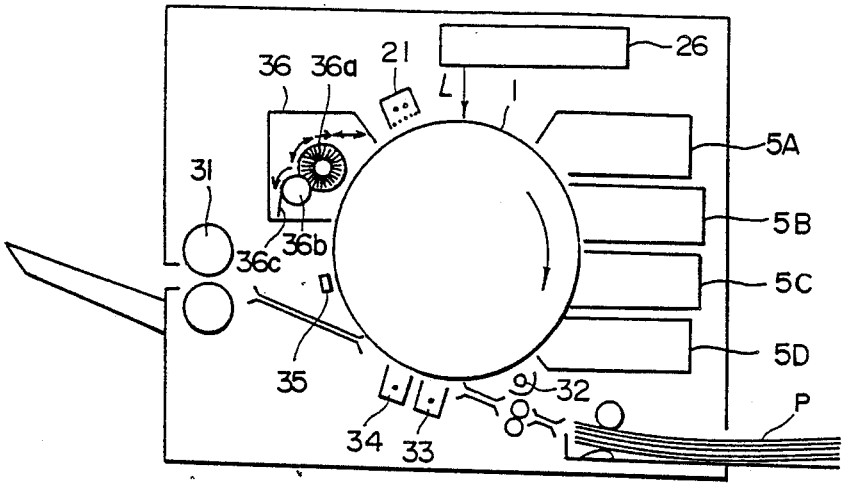
FIG. 1 is a schematic view showing the internal structure of one embodiment of the present invention.

FIG. 1 is a schematic view showing the internal structure of one embodiment of the present invention. In FIG. 1: reference numeral 1 denotes an image retainer enabled to revolve in the direction of arrow; numeral 21 a corona charging device; letter L an image exposure light emitted from a laser optical system 26; 5A, 5B, 5C and 5D developing devices having Yellow, Magenta, Cyan and Black toners, respectively; numeral 32 a pre-transfer image exposure lamp; numeral 33 a transfer electrode; numeral 34 a separating electrode; letter P a transfer paper or a transfer material; numeral 35 a photosensor for detecting the density of a reference toner image on the image retainer; and numeral 36 a cleaning device which includes a fur brush 36*a*, a toner recovery roller 36*b* and a scraper 36*c*. The multicolor image forming apparatus thus constructed forms a multicolor image in the following manner.

The image retainer 1 has its surface charged uniformly by the corona charging device 21 using the scorotron and then illuminated with the image exposure light L according to recording data of Yellow component from the laser optical system 26. Thus, an electrostatic latent image is formed. This electrostatic latent image is developed by the developing device 5A containing the Yellow toner.

The image retainer formed with the Yellow toner image is uniformly charged again by the corona charging device 21 and is exposed to the image light L according to the recording data for a Magenta component. The electrostatic latent image thus formed is developed by the developing device 5B reserving the Magenta toner. As a result, there is formed on the image retainer 1 a two-color toner image which is composed of the Yellow toner and the Magenta toner. From now on, the electrostatic latent image is likewise developed with the Cyan toner and the Black toner in a superposed manner to form a four-color toner image on the image retainer 1.

Figure 4:
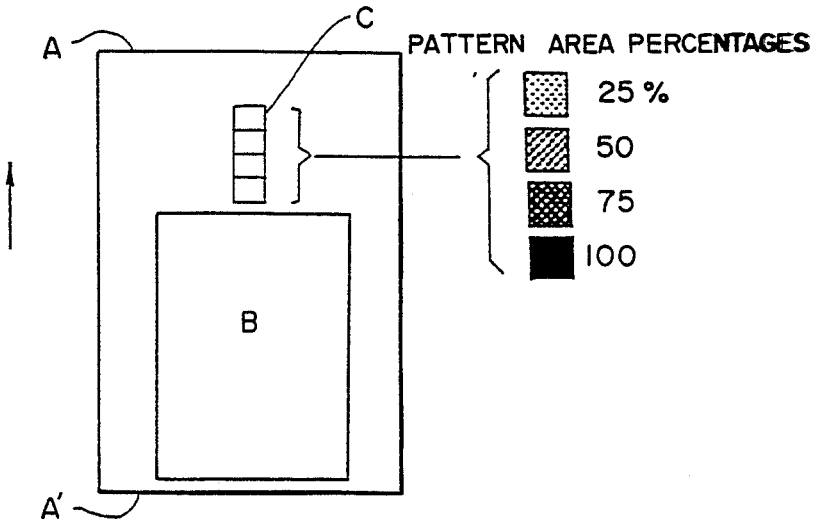
FIG. 4 is an expanded view showing the surface of an image retainer in a top plan.

The photosensor 35 provided according to the present invention is constructed of a light emitting element and a light receiving element and reads out the reflective density of a reference toner image C of one of the Yellow, Magenta, Cyan and Black colors, as shown in FIG. 4.

In the multicolor toner image obtained on the image retainer 1, only an image portion B except for the reference toner image is transferred to the recording paper P by the transfer electrode 33. The recording paper P is separated from the image retainer 1 by the separating electrode 34 and fixed by a fixing device 31. In this meanwhile, the image retainer 1 is cleaned by a charge eliminating electrode and the cleaning device 36.

The fur brush 36*a* is kept away from contact with the image retainer 1 during the image formation and is brought into contact with the image retainer 1, after the multicolor toner image has been formed on the image retainer 1 and transferred, to scrape away the residual toner while revolving in the direction of arrow.

After this cleaning operation, the fur brush 36*a* leaves again the image retainer 1. The toner recovery roller 36*b* is so suitably biased, while revolving in the direction of arrow, as to recover the toner in association with the fur brush 36*a*. The toner thus recovered is scraped away by the scraper 36*c* until it is temporarily reserved.

Figure 2:
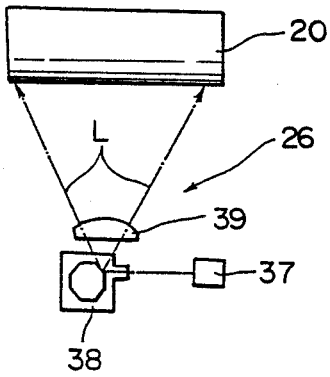
FIG. 2 is a top plan view showing a laser optical system of the embodiment.

FIG. 2 shows the laser optical system 26 for effecting the image exposures of the aforementioned embodiment. In FIG. 2, reference numeral 37 designates a laser diode; numeral 38 a rotary polygon mirror; and numeral 39 an f-$\theta$ lens. The laser optical system 26 forms the reference toner image together with an image on the image retainer 1. For image formation, a hard copy is formed on the basis of image data which are transferred from an image data output device of various modes such as an image data forming device, an image memory, an image reader, an image processor or an image display.

FIG. 4 is an expanded view showing the surface of the image retainer in a top plan. The arrow appearing in FIG. 4 indicates the direction of movement (or revolution). Lines indicated at A and A' become coincident on the image retainer. On the other hand, letter B indicates an image portion, i.e., a region to be transferred to the transfer material.

In the present invention, a reference toner image is formed in a position C of FIG. 4 with one of Yellow, Magenta, Cyan and Black toners. The reflective density of the reference toner image is read out by the density detector or photosensor 35 to reflect the detected result on the image forming conditions of all colors. FIG. 4 shows the case of the reference toner image of four gradations of different recording area percentages.

Figure 5:
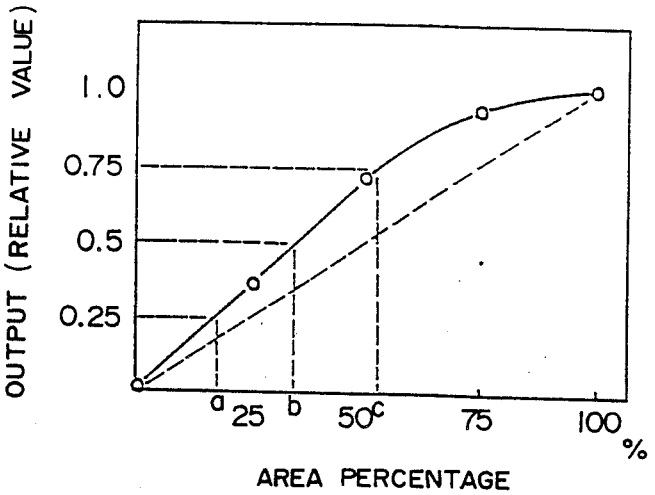
FIG. 5 is a graph presenting the relation between the recording area percentage and the image density output.

FIG. 5 presents a typical example of the measurement of the reference toner image by plotting the output of the density detector against the recording area percentage (i.e., the data level). The recording area percentage relates to the dot number per unit area due to the spot light. A broken curve appearing in FIG. 5 presents an ideal case in which the density is proportional to the area percentage of the image data. The ordinary curve is shifted from that ideal curve, and the image forming conditions are set to correct that shift.

The image forming conditions are exemplified by the following items:

(1) Image data making condition (for setting the original density vs. the area percentage);

(2) Latent image forming condition (such as the charging potential, the exposure intensity and the exposure spot diameter); and (3) Developing condition (such as the toner density and the (DC or AC) developing bias).

In the present invention, for setting the image forming conditions, the following two gradation steps may preferably be follows:

(1) The maximum and minimum densities are confined within respectively constant ranges; and (2) The gradation expressions are adjusted to become identical.

More specifically, the conditions are set for the item (1) such that the image can establish a sufficient contrast but no fog on the background and for the item (2) such that a half tone can be expressed while retaining the maximum and minimum densities achieved by the condition (1). This makes it desirable that the image forming conditions set at the items (1) and (2) can vary the recording characteristics independently of each other.

For these settings of the image forming conditions:

(1)→(3):

The confinement of the maximum and minimum densities within the respectively constant ranges resorts to the developing conditions; and (2)→(1) and (2):

The adjustment of the gradation expressions resorts to the image data making conditions and the latent image forming conditions. The developing conditions (3) can control the maximum density and the appearance of the fog but hardly the gradation expression characteristics only.

On the contrary, the image forming conditions (1) and (2) (except for the charging potential) cannot control the maximum density and the appearance of the fog but the gradation expression characteristics.

Figure 7B:
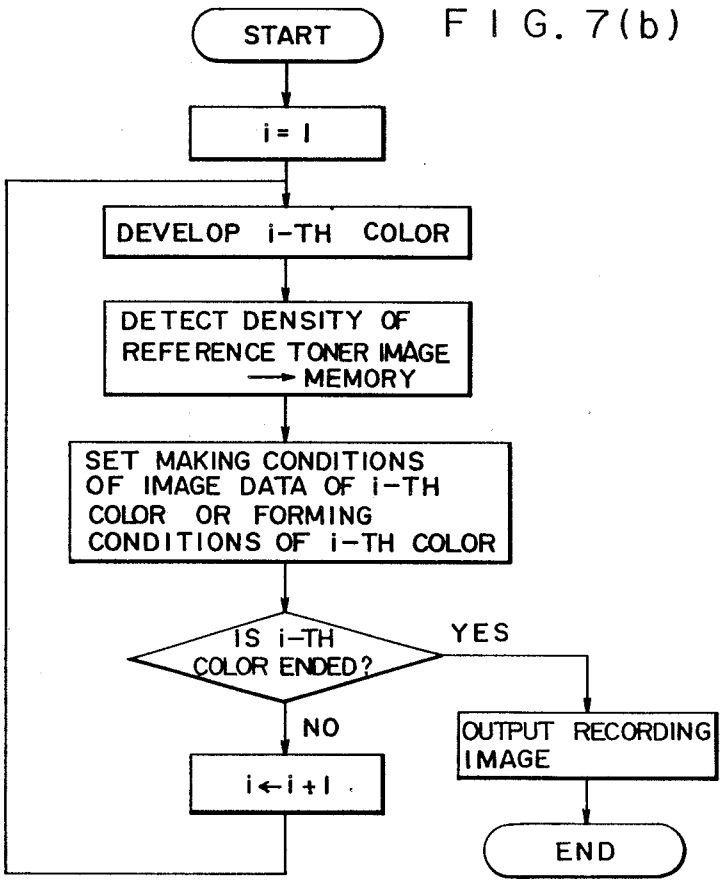
FIGS. 7(*a*) and 7(*b*) are flow charts showing the respective methods of setting image forming conditions.
Figure 7A:
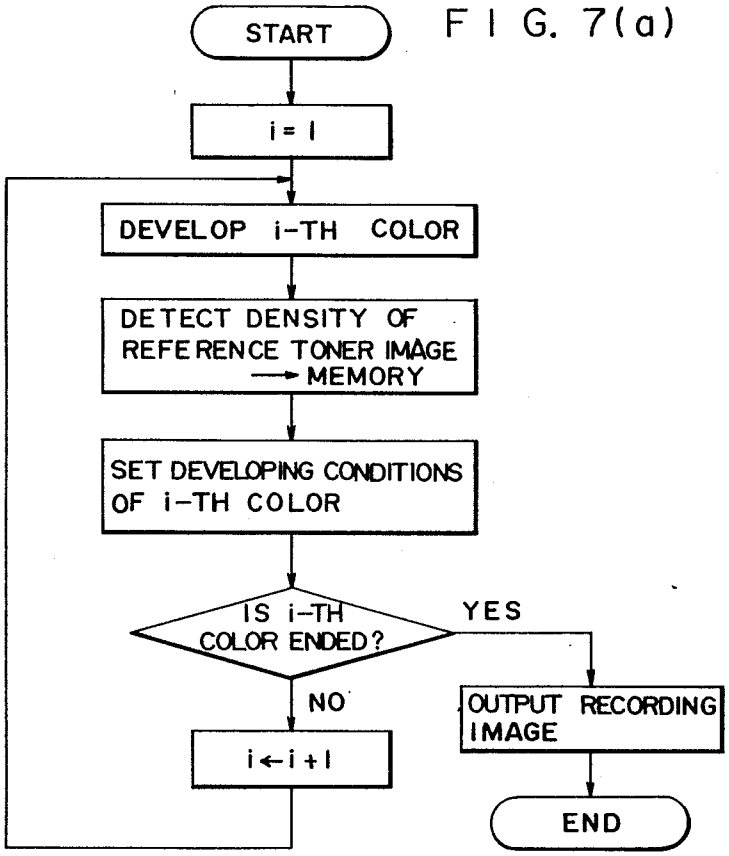

FIGS. 7(*a*) and 7(*b*) are flow charts showing the process for setting the image forming conditions. FIG. 7(*a*) corresponds to the adjustment of the item (1), and FIG. 7(*b*) corresponds to the adjustment of the item (2). By these adjustments, the image forming conditions are set from a subsequent recording image formation. If, therefore, the developing condition and the image data making condition or the latent image forming condition are satisfied following the flow charts of FIG. 7(*a*) and FIG. 7(*b*), for example, the adjustments are always made before the maximum and minimum densities and gradation expression characteristics are broken.

The setting of the item (1) under the image forming condition (3) (i.e., the developing condition) is accomplished by experimentally determining the developing characteristics such as the developing bias or the toner density in advance and by using the determined data.

The setting of the item (2) under the image forming condition (1)(i.e., the image data making condition) is accomplished by the manner presented in FIG. 5. In case the result detected by the density detector is expressed by the curve (indicated by the solid line), a value corresponding to the area percentage a indicating the density of 25% of the maximum density may be set as image data if the 25% density is to be obtained. Likewise, the densities of 50% and 75% are obtained at the area percentages b and c. Thus, the image data are made. In order to obtain such image data from the image information of an original, it can be said that the dither method or the density pattern method is suitable.

According to these methods, a binary or multivalue image data are obtained by comparing the original image data and a threshold value by means of a comparator. The dither method applies threshold values different for individual pixels to the original image data. Of these, the systematic dither method prepares a plurality of threshold values as a two-dimensional pattern having a suitable size to periodically apply them to the original image data. This systematic dither method is preferable when it is used in the present invention, because it has a simple circuit structure and finds its suitable application to a real time processing. On the other hand, the density pattern method converts the individual pixels of the original image data into a density pattern composed of a matrix of a plurality of pixels. In this case, to the present invention prefers the method of preparing patterns corresponding to the individual density values in advance. The more the number of these patterns, the better.

A variety of combinations are conceivable for the settings and arrays of the density values of the individual elements of the dither threshold pattern or density pattern (which will be referred to as the "reference density matrix"). The quality of a multicolor image, which is finally obtained by making recording data using the reference density matrix as reference signals to make a recording on the basis of the recording data, depends upon how the density values of the aforementioned individual elements are to be combined, as has been clarified by our investigations. If this fact is applied, therefore, the most proper reference signals can be set to obtain a multicolor image of high quality at all times by preparing a plurality of reference density matrices of different combinations of the density values of the individual elements and by selecting the reference density matrix in accordance with the state of the input image or another condition or by adding a suitable value to or subtracting it from each matrix element.

FIG. 8 presents the relations between the original image density and the pixel density at the recording level. The individual curves present the results which are obtained by using the reference matrix formed from the reference data group shown in FIGS. 9(*a*) to 9(*d*). In FIGS. 9(*a*) to 9(*d*), the abscissa indicates the density level, and the ordinate indicates the values of the reference data set in the reference matrix. FIG. 9(*a*) corresponds to the case in which the individual reference data are set evenly with respect to the density; FIG. 9(*b*) corresponds to the case in which the individual reference data are set denser for the lower density side with reference to the density; FIG. 9(*c*) corresponds to the case in which the individual reference data are set denser for the higher density side with respect to the density; and FIG. 9(*d*) corresponds to the case in which the individual reference data are set denser at a medium with respect to the density. These cases establish the gradation reproducibility of the curves a, b, c and d of FIG. 8. As a result, the relation between the original image density and the recording image density can be controlled by selecting the set values of the individual reference data.

Figure 10:
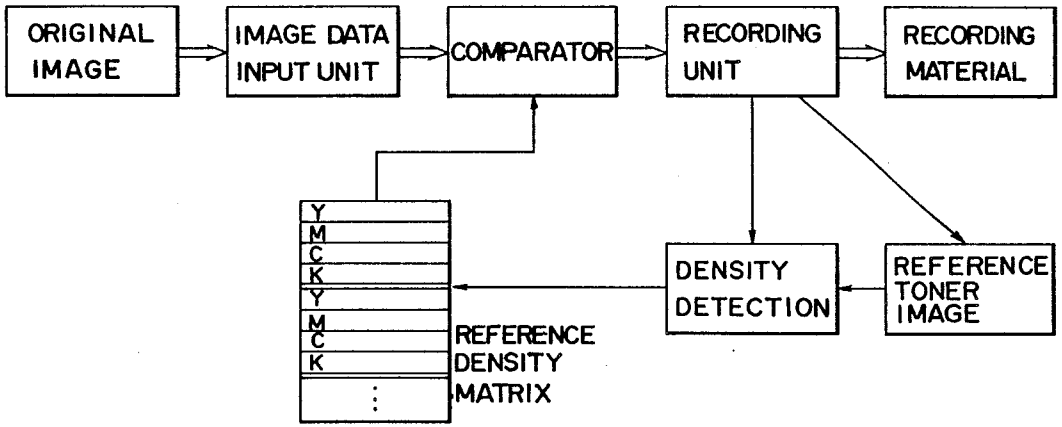
FIG. 10 is a block diagram showing the flow of image data to a multicolor image forming apparatus.
Figure 11:
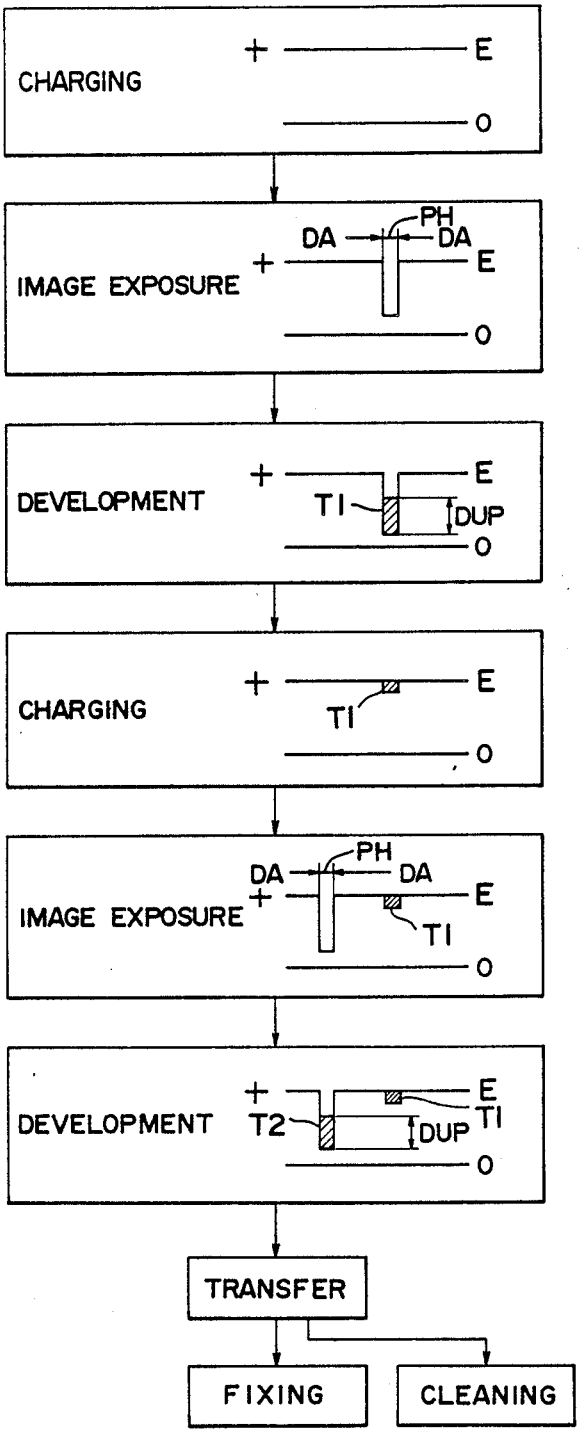
FIG. 11 is a flow chart showing the changes in the surface potential of the image retainer.

According to the present invention, the reference toner image is read out to determine an inverse function of the relation between the area percentage and the output so that the density distribution of the reference data in the reference matrix may accordingly be determined. For this determination, there is either a method, in which a plurality of reference matrices are prepared in a ROM or the like in advance so that the most proper one may be selected for use, or a method in which a reference matrix is calculated from an inverse function determined and is written for use in a RAM or the like. The most fundamental block diagram of the former case is presented in FIG. 10.

The setting of the item (2) of the image forming condition (2) (i.e., the latent image forming condition) is accomplished by arranging experimental data in advance like the setting of the condition (3) to set the expousre light intensity and the spot diameter in a manner to match the experimental data.

The gist of the present invention is to accomplish the setting of the item (2) or the items (1) and (3) only for the toner of a specified color and to reflect the result on another color. We have experimentally determine the recording characteristics under the aforementioned image forming conditions for the individual color toners and have found that the difference among the toners is markedly small. The characteristics are substantially identical especially for the conditions (1) (the image data making condition) and (2) (the latent image forming condition). On the basis of this fact, the present invention has been conceived.

When the present invention is to be practised, it is sufficient to read out only the reference toner image of one color and to prepare only one kind of photosensor, but it is unnecessary to consider the difference in the output characteristics among the colors.

In this example, the reference toner image was formed with the Black toner. The item (1) was controlled by the DC bias, and the item (2) was controlled by the area percentage, the exposure spot diameter and the exposure light intensity. These controls have revealed always constant color expression characteristics for all the cases.

Figure 6:
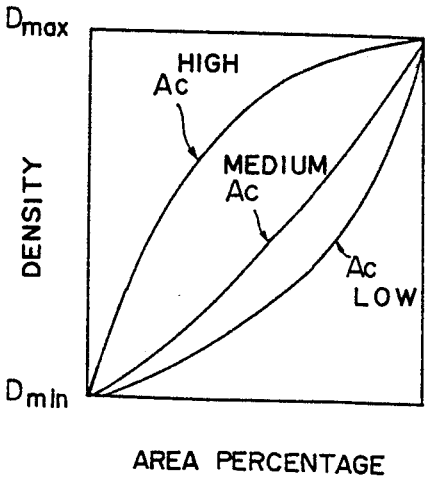
FIG. 6 is a graph presenting the relations between the recording area percentage and the image density for different AC biases.

FIG. 6 is a graph presenting the changes of the gradation expressions against the common image area percentage by the AC bias. In view of FIG. 6, the gradation expressions can also be adjusted by the AC bias.

Next, the developing devices 5A, 5B, 5C and 5D (which will be designated simply at 5) belonging to the multicolor image forming apparatus will be described in the following.

Figure 3:
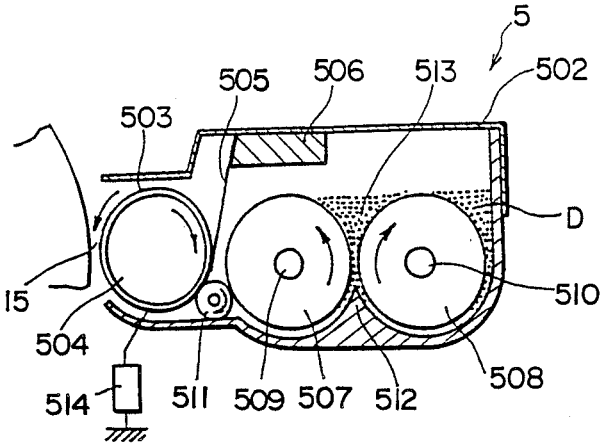
FIG. 3 is a section showing the developing device of the embodiment.

FIG. 3 is a section showing the developing device 5 of the multicolor image forming apparatus. In FIG. 3: reference numeral 502 designates a housing; numeral 503 a sleeve; numeral 504 a magnetic roller having N and S poles and acting as magnetic field generating means disposed in the sleeve or developer conveying means; numeral 505 a layer forming member; numeral 506 a member for fixing the layer forming member 505; numeral 507 a first agitating member; and numeral 508 a second agitating member. Numerals 509 and 510 designate the shafts of revolution of the agitating members 507 and 508, respectively; numeral 511 a sleeve cleaning member; numeral 513 a developer reservoir; numeral 514 a development bias power source; numeral 15 a developing region, i.e., a region in which the toner conveyed by the sleeve 503 is enabled to move to the image retainer by the electrostatic force; and letter D a developer composed of a toner and a carrier. In the developing device thus constructed, the two agitating members 507 and 508 are of screw type and revolve in the directions of arrows to agitate and convey the developer. The agitating member 507 is shaped to convey the developer forwardly in the axial direction, whereas the agitating member 508 is shaped to convey the developer backwards. Between these agitating members 507 and 508, there is formed a partition 512 for preventing the developer from being left. The partition 512 allows the developer to be exchanged rightward and leftward in FIG. 3.

The supply of the toner to the developing device 5 is accomplished from the forward side thereof, and the toner supplied is circulated generally to the backward side by the agitating member 508 and to the forward side of the agitating member 507 so that the toner and the carrier are uniformly mixed. However, the position of the toner supply should not be limited to the aforementioned one but may be effected from the righthand side of FIG. 3 uniformly to the sleeve 503.

Thus, the developer D is sufficiently agitated and mixed and is conveyed in the same direction as that of revolution of the sleeve 503 by the conveying forces of the sleeve 503 and magnetic roller 504 revolving in the arrow directions. With the surface of the aforementioned sleeve 503, there is brought into pressure contact the layer forming member 505 which is held by the fixing member 506 extending from the housing 502, so that a developer layer is formed while the amount of the developer D to be conveyed being regulated.

Incidentally, another means for forming the developer layer may be exemplified by either a magnetic or non-magnetic regulating plate arranged at a constant spacing from the sleeve or a magnetic roller arranged in the vicinity of the sleeve, known in the prior art.

The carrier and toner composing the developer is the more advantageous for the resolution of the image quality and the gradation reproducibility if they have the smaller diameters. Even in case the carrier of the developer layer used has a small diameter of 30 μm or less, for example, the developer can be automatically cleared of impurities or aggregates to form a magnetic brush of uniform length by using the means such as the aforementioned layer forming member 505. Even in case the aforementioned carrier is made to have a diameter as small as the toner, moreover, the impurities can also be prevented from stealing to form a magnetic brush of uniform length.

The sleeve cleaning roller 511 revolves in the direction of arrow (as shown in FIG. 3) to scrape the developer, which has passed over the developing region and consumed its toner, away from the sleeve 503. This makes it possible to hold constant the amount of the toner to be conveyed to the developing region so that the developing conditions are stabilized.

Next, the preferable composition of the developer to be used in the multicolor image forming apparatus of the present invention will be described in the following.

The composition of the toner is exemplified as follows:

1. Thermoplastic resin (as binder) in 80 to 90 Wt %:

For example:
polystyrene, styrene-acryl polymer, polyester, polyvinylbutyral, epoxy resin, polyamide resin, polyethylene or copolymer of ethylene-vinylacetate, or their mixture:

2. Pigment (as coloring agent) in 0 to 15 Wt %:

For example:
Black: Carbon Black;
Yellow: benzidine derivative;
Magenta: rhodamine B lake or carmine 6B;
Cyan: phthalocyanine, or dye of sulfonamide derivative;

3. Charge controller in 0 to 5 Wt %:

For example:
Plus Toner: dye of electron donor of nigrosine, alkoxylated amine, alkyl amide, chelate, pigment, or quaternary ammonium salt; and
Minus Toner: organic complex of electron receptor, chlorinated paraffin, chlorinated polyester, polyester peroxide, or chlorinated copper phthalocyanine;

4. Fluidizer:

For example:
colloidal silica, hydrophobic silica, silicone varnish, metallic soap, or nonionic surface-active agent;

5. Cleaning agent (for preventing the filming of toner on photosensitive member):

For example:
metallic salt of fatty acid, oxidized silicic acid having organic radicals on surface, or surface-active agent of fluorine; and 6. Filler (for improving surface luster of image and reducing cost for raw materials):

For example:
calcium carbonate, clay, talc or pigment, which may contain a small amount of magnetic power for preventing the fog or toner dispersion onto the image surface.

This magnetic powder may be exemplified by 0.1 to 5 Wt % of tri-iron tetroxide, ν-ferric oxide, chromium dioxide, nickel ferrite or powder of iron alloy having a particle diameter of 0.1 to 1 mm. The content of the above-specified magnetic powder may desirably be 1 Wt % or less so as to make the color tone of the toner, especially, the color toner hue.

The resin to be used as a pressure fixing toner to be plastically deformed and fixed to the paper by a force of about 20 $Kg/cm^2$ may be exemplified by a binding resin such as wax, polyolefins, copolymer of ethylene-vinylacetate, polyurethane or rubber.

The toner can be prepared of the above-specified materials by the method known in the prior art.

In order to form a more preferable image by the present apparatus, the toner diameter (which weight-averaged) may preferably be about 50 μm or less, especially 15 to 1 μm. If the value 15 μm is exceeded, the image quality is degraded. If the value 50 μm is exceeded, a thin word becomes difficult to read. For a value not more than 1 μm, a fog takes place to lose the image clearness. Incidentally, the particle diameters or their average values of the toner and carrier are weight-averaged and measured by means of the coulter counter (produced by Coulter Electronics, Inc.) On the other hand, the specific resistance of the particle is determined from the value of a current which flows when an electric field of $10^2$ to $10^5$ V/cm is established between a load of 1 $Kg/cm^2$ and a bottom electrode after the particle has been tapped in a container having a sectional area of 0.50 $cm^2$ to have a thickness of about 1 mm under that load.

The carrier has the following composition which is basically similar to that of the components of the toner.

The carrier particles are composed majorly of magnetic particles and a resin and may preferably be rounded to have a weight-averaged diameter of 50 μm or less, especially within a range of 5 μm to 40 μm so as to improve the resolution and the gradation reproducibility. Here, if the value 40 μm or 50 μm is exceeded by the carrier particle diameter, the magnetic brush becomes long and coarse to make it difficult to thin the developer layer so that the developability is deteriorated to drop the image quality. For the carrier particle diameter less than 5 μm, the developability, frictional chargeability and fluidity of the developer are deteriorated to scatter the carrier.

Moreover, in order to prevent the carrier from sticking to the image retainer surface as a result of the injection of charges by the bias voltage or the charges for forming the latent image from disappearing, the resistivity of the carrier may be set to $10^8$ Ωcm or more, preferably $10^{13}$ Ωcm or more, or more preferably $10^{14}$ Ωcm or more.

This carrier is prepared by covering the surface of a magnetic member with a resin, or by dispersing magnetic particles in the resin and by selecting the particles with known particle diameter selecting means.

The rounding of the carrier may be carried out by the following method:

(1) Resin-coated carrier: Round magnetic particles are selected; and (2) Magnetic powder dispersed carrier: A dispersion resin is rounded, after it has been prepared, by hot wind or water or is prepared directly in the rounded form by a spray-dry method.

The toner and carrier described above may preferably be mixed at such a ratio that the sums of the individual surface areas may be equal. For example, if the toner has an average diameter of 10 μm and a specific weight of 1.2 $g/cm^3$ whereas the carrier has an average diameter of 35 μm and a specific weight of 4.5 $g/cm^3$, the toner density (i.e., the weight ratio of the toner to the developer) may be appropriately set at 2 to 30 Wt %, preferably 5 to 15 Wt %. If the toner density is smaller than the above-specified range, the toner becomes difficult to sufficiently carry and has an excessively high charge so that a sufficient development cannot be carried out. If, on the other hand, the toner density exceeds that range, the toner has an insufficient charge and becomes liable to leave the carrier so that a serious problem is caused by the dirt in the apparatus resulting from the toner dispersion.

With the structure thus far described, multicolor images were formed under the following conditions. As shown in FIG. 5, a plurality of reference toner images having different recording area percentages were formed on the non-transfer portion of the image retainer, and their reflective densities were read out so that the image forming conditions were set according to the reflective densities read out:

TABLE 1

| | | |
|---|---|---|
| Primary Scanning Rate of Laser Beam | | 800 m/s |
| Auxiliary Scanning Rate of Laser Beam | | 150 mm/s |
| Scanning Period of One Pixel | | 78 ns |
| Image Retainer | | Organic Photosensitive (Drum of 180 ø mm) |
| | Linear Velocity | 150 mm/s (c.w.) |
| Surface Potential | Non-Exposed portion | −700 V |
| | Exposed portion | −50 V |
| Sleeve (Common) | Diameter | 20 mm |
| | Material | Non-Magnetic Stainless Steel (Blasted to 3 μm) |
| | Linear Velocity | 500 mm/s (c.c.w.) |
| Magnetic Roll (Common) | No. of Poles | 12 |
| | Revolution Speed | 1,500 r.p.m. (c.w.) |
| Magnetic Flux Density of Sleeve Surface (Common) | | 600 G (Max) |
| Development Gap (Common) | | 500 μm |
| Bias DC | Yellow | −600 V |
| | | Standard value |
| | Magenta | −600 V |
| | Cyan | −600 V |
| | Black | −600 V |
| AC | (Common) | 3 $KV_{p-p}$, 5 KHz |
| Amount of Adhesion of Toner to Sleeve (Common) | | 0.6 mg/cm$^2$ |

Write Resolution: 16 dots/mm; and Write Level: Binary.

On the other hand, the recipe of the developer was as follows:

(Recipe of Developer)

| Toner composition | |
|---|---|
| polystyrene | 45 Wt parts; |
| polymethyl methacrylate | 44 Wt parts; |
| varyfast (or charge controller) | 0.2 Wt parts; |
| coloring agent | 10.5 Wt parts. |

Incidentally, the coloring agent was exemplified by Auramine as the Yellow toner, Rhodamine B as the Magenta toner, copper phthacyanine as the Cyan toner, and carbon black as the Black toner. The above-specified components were mixed, blended and classified to a desired toner.

| Carrier (coated with resin) composition | |
|---|---|
| Core | ferrite; |
| Coating resin | styrene-acryl (4:6); |

-continued

| Carrier (coated with resin) composition | |
|---|---|
| Magnetization | 27 emu/g; |
| Particle diameter | 30 μm; |
| Specific weight | 5.2 g/cm$^3$; and |
| Specific resistance | $10^{13}$ Ωcm or more. |

The above-specified components were mixed, blended, classified and then heated with hot wind to prepare the round carrier.

Next, the aforementioned carrier and the individual color toners were sufficiently mixed at respectively predetermined ratios to prepare the target developers. Here, all the weight ratios of the toners to the developers (composed of the toners and the carrier) were set at 5 to 10 Wt %.

Figure 12A:
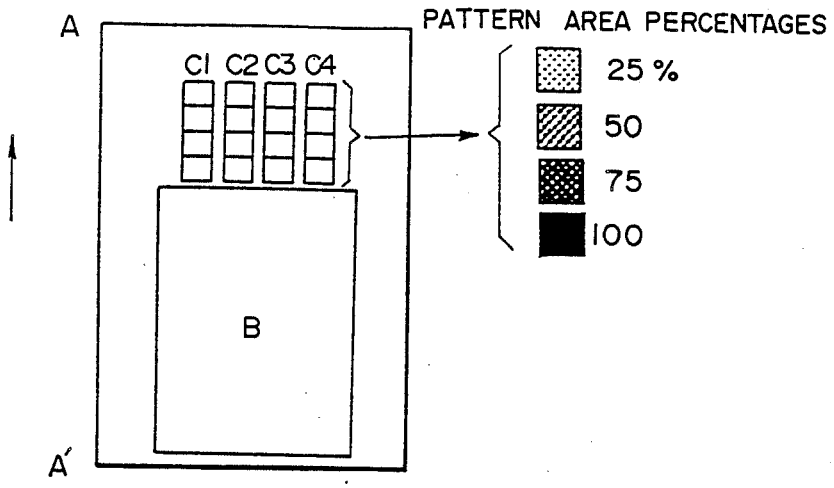
FIGS. 12(*a*) and 12(*b*) are diagrams showing the surface of an image retainer in a top plan in accordance with another embodiment of the present invention.
Figure 12B:
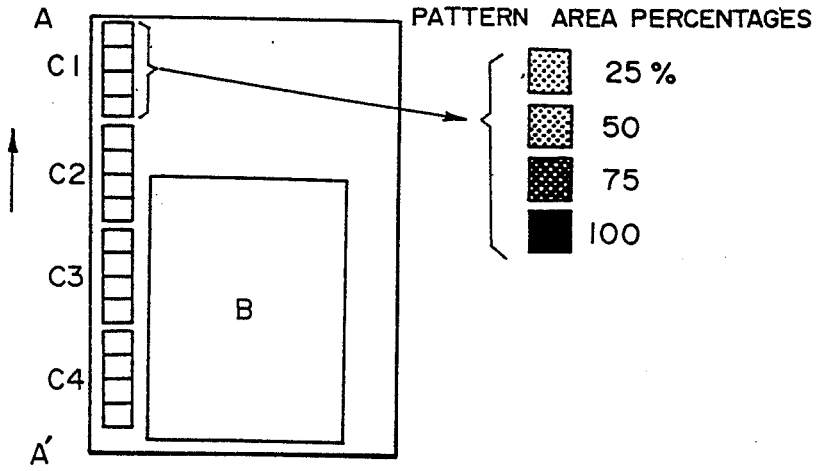

In another embodiment of the present invention, reference toner images (of four gradations, as shown) having different recording area percentages are formed in positions C1 to C4 of FIG. 12(*a*), respectively, with the Yellow, Magenta, Cyan and Black toners. Their reflective densities are read out by the density detectors using the photosensors 35 and are reflected on the image forming conditions.

If the foregoing items (1) and (2) were set for the colors, the relations of the recording characteristics of the individual colors can be held constant at all times. As a result, the color expression characteristics are stable.

The photosensors 35 required for reading out the reference toner images C1 to C4 shown in FIG. 12(*a*) are four in number. Since the reference toner images C1 to C4 have different colors, the output characteristics of the photosensors are naturally different. The relations between their reflective densities and output characteristics are experimentally determined in advance so that they may be used as parameters for conversions into density values.

We have made a system for setting the image forming conditions by the combinations of No. 1 to No. 5, as listed up in Table 2. As a result, the image forming conditions could form images having constant color expression characteristics at all times:

TABLE 2

| No. | 1 | 2 |
|---|---|---|
| 1 | Toner Density | Area Percentage |
| 2 | Toner Density | Exposure Intensity |
| 3 | Toner Density + DC Bias | Exposure Spot Diameter |
| 4 | Toner Density + DC Bias | Area Percentage |
| 5 | Toner Density + DC Bias | AC Bias |

Incidentally, No. 5 of the Table 2 presents the example in which the item (2) was set by the AC bias with excellent results. This is because the gradation expression characteristics are varied by the AC bias for the common image area percentage, as shown in FIG. 6.

In this example, the reference toner images C1, C2, C3 and C4 were formed in the positions indicated in FIG. 12(*a*), to which the present invention should not be limited. As shown in FIG. 12(*b*), for example, the densities of the reference toner images C1, C2, C3 and C4 of all the colors can be read out by the single photosensor. So long as the other circumstances allow, moreover, it is desired to form reference toner images having as many as gradations.

In the multicolor image forming apparatus according to the present invention, the images formed with the simple structure are so excellent over the prior art that not only the maximum density of each color is held constant but also the gradation expression of each color is adjusted so that the color balance can be maintained excellent.

What is claimed is:

1. A multicolor image forming method comprising the steps of:

forming a multicolor toner image on an image retainer by a plurality of developing means; and transferring said multicolor toner image to a transfer material, wherein the improvement comprises:

forming a reference toner image on a non-transfer portion of said image retainer by any of said developing means; said reference toner image being a pattern having a predetermined recording area percentage.

reading out the reflective density of said reference toner image; and setting image forming conditions in accordance with the reflective density read out.

2. The method of claim 1 wherein said image forming conditions are those for making image data.

3. The method of claim 1 wherein said image forming conditions are those for forming latent images.

4. The method of claim 1 wherein said image forming conditions are those for developing.

5. The method of claim 16 wherein said image forming conditions are those for making image data.

6. The method of claim 16 wherein said image forming latent images.

7. The method of claim 16 wherein said image forming conditions are those for developing.

8. A multicolor image forming method comprising the steps of:

forming a multicolor toner image on an image retainer by a plurality of developing means; and transferring said multicolor toner image to a transfer material.

wherein the improvement comprises the steps of:

forming a reference toner image on a non-transfer portion of said image retainer by any of said developing means;

reading out the reflective density of said reference toner image; and setting image forming conditions in accordance with the reflective density read out, a corresponding table of a recording area percentage for forming the reference toner image and said reflective density corresponding to said setting image forming conditions, an area percentage corresponding to a density value of each color to be recorded is determined based on said corresponding table, and the area percentage thus determined is used as image data for forming a latent image of each color.

9. The method of claim 8 wherein said image forming conditions are those for making image data.

10. The method of claim 8 wherein said image forming conditions are those for forming latent images.

11. The method of claim 8 wherein said image forming conditions are those for developing.

12. A multicolor image forming apparatus for forming a multicolor image on an image retainer having means for transferring said multicolor image to a transfer material, said apparatus comprising means for forming a plurality of reference toner images having different recording area percentages on non-transfer portions of said image retainer;

means for reading out the reflective densities of said reference toner images; and means for setting image forming conditions in accordance with said reflective densities.

13. The apparatus of claim 1 wherein said image forming conditions are those for making image data.

14. The apparatus of claim 1 wherein said image forming conditions are those for forming latent images.

15. The apparatus of claim 1 wherein said image forming conditions are developing conditions.

16. A multicolor image forming method comprising the steps of:

forming by a spot light a plurality of latent images having different dot numbers per unit area;

forming reference toner images by developing said latent images with toner;

reading out the reflective densities of said reference toner images; and setting image forming conditions in accordance with the reflective densities read out.

* * * * *